US010173125B2

(12) United States Patent
Kunz

(10) Patent No.: US 10,173,125 B2
(45) Date of Patent: Jan. 8, 2019

(54) CIRCULAR LOGIC GAME

(71) Applicant: Mark David Kunz, Firestone, CO (US)

(72) Inventor: Mark David Kunz, Firestone, CO (US)

( * ) Notice: Subject to any disclaimer, the term of this patent is extended or adjusted under 35 U.S.C. 154(b) by 337 days.

(21) Appl. No.: 15/132,966

(22) Filed: Apr. 19, 2016

(65) Prior Publication Data

US 2017/0296911 A1 Oct. 19, 2017

(51) Int. Cl.

| | |
|---|---|
| ***A63F 3/00*** | (2006.01) |
| ***A63F 3/04*** | (2006.01) |
| ***A63F 9/00*** | (2006.01) |
| ***A63F 9/24*** | (2006.01) |

(52) U.S. Cl.

CPC ..... *A63F 3/0415* (2013.01); *A63F 9/0098* (2013.01); *A63F 9/24* (2013.01); *A63F 2003/0418* (2013.01)

(58) Field of Classification Search

None

See application file for complete search history.

(56) References Cited

U.S. PATENT DOCUMENTS

| | | | | |
|---|---|---|---|---|
| 4,019,740 A * | 4/1977 | Ball | A63F 3/00176 | 273/261 |
| 4,360,347 A * | 11/1982 | Ghaznavi | A63F 9/0811 | 273/157 R |
| 5,772,209 A * | 6/1998 | Thompson | A63F 3/0415 | 273/268 |
| 6,619,661 B1 * | 9/2003 | Collins | A63F 9/10 | 273/157 R |
| 2008/0161106 A1 * | 7/2008 | Morris | A63F 3/0415 | 463/31 |

* cited by examiner

*Primary Examiner* — Sunit Pandya

(74) *Attorney, Agent, or Firm* — Dunlap Bennett & Ludwig PLLC; Brendan E. Squire

(57) ABSTRACT

A circular logic puzzle The "CIRCULAR" puzzle has similarities to Sudoku and Latin squares in problem solving, and in this new circular format the many different varieties of game play and playing surfaces can be produced gives many new challenges and perspectives for those who enjoy solving logic puzzles.

12 Claims, 6 Drawing Sheets

CIRCULAR LOGIC GAME

BACKGROUND OF THE INVENTION

The present invention relates to games, and more particularly to logic puzzle games using a Latin squares type solution.

A familiar Latin squares type solution game is Sudoku. The Sudoku and Latin squares type games generally have the same format, and the challenges are usually limited to a square type puzzle feature, such that the player may lose interest in playing the games.

As can be seen, there is a need for an alternate format for these games, so as to keep these games from getting old or stale.

SUMMARY OF THE INVENTION

In one aspect of the present invention, a game includes: a playing surface carrying indicia of a circular grid defined by a number of concentric circular lines disposed in a spaced apart relation and a number of radial lines extending in a space apart relation from a center of the circular grid and intersecting the concentric circular lines; wherein the number of concentric circular lines is equal to the number of radial lines; a plurality of fields defined between an adjacent pair of radial lines and an adjacent pair of circular lines, wherein a row is defined by the plurality of fields between the adjacent pair of radial lines, and a ring of circles is defined by the plurality of fields between the adjacent pair of circular lines; and a set of unique characters, wherein a number of unique characters within the set is equal to the number of radial lines; wherein only one character may occupy a single field. The game may also provide that any adjacent field cannot contain an identical character. The game may also provide that the fields within each row contain one of each character within the set. In similar manner some embodiments of the game may provide that the fields within each ring of circles contain one of each character within the set.

In other variants of the game, the circular grid may also carry indicia indicating a random pattern on the circular grid, the random pattern defining a number of contiguous fields corresponding to the number of radial lines. The fields within the random pattern may contain one of each character within the set. The random pattern may be defined by a discrete set of fields. Alternatively, the random pattern may be defined by an overlapping set of fields. The set of characters may be numbers, symbols, or images. The playing surface may be presented on a computer display.

Other aspects of the invention include a method of game play, including the steps of: providing a playing surface carrying indicia of a circular grid defined by a number of concentric circular lines disposed in a spaced apart relation and a number of radial lines extending in a space apart relation from a center of the circular grid and intersecting the concentric circular lines; wherein the number of concentric circular lines is equal to the number of radial lines, a plurality of fields defined between an adjacent pair of radial lines and an adjacent pair of circular lines, wherein a row is defined by the plurality of fields between the adjacent pair of radial lines, and a ring of circles is defined by the plurality of fields between the adjacent pair of circular lines; selecting a set of unique characters, wherein a number of unique characters within the set is equal to the number of radial lines; and populating the fields with the characters wherein only one character may be placed to occupy a single field.

In some embodiments, the fields may be populated with the characters wherein any adjacent field cannot contain an identical character. In other embodiments, the fields may be populated, with the characters wherein the fields within each row contain one of each character within the set. The method of game play may also include populating the fields with the characters wherein the fields within each ring of circles contain one of each character within the set. The method may also include applying indicia indicating a random pattern on the circular grid, the random pattern defining a number of contiguous fields corresponding to the number of radial lines; and populating the fields with the characters wherein the fields within the random pattern contain one of each character within the set. In other embodiments, the method may also provide a clue, wherein one or more characters are pre-populated in the fields.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a circular puzzle game has similarities to Sudoku and Latin squares in problem solving, and in this new format the many different varieties that can be produced gives many new challenges and perspectives for those who enjoy solving logic puzzles.

Figure 1:
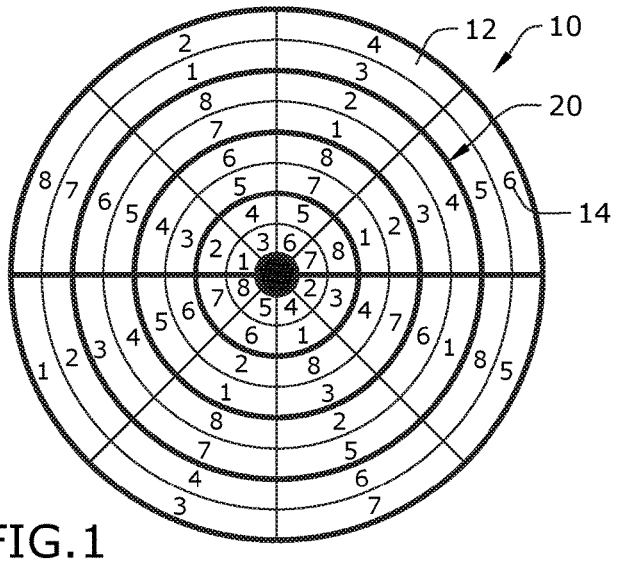
FIG. 1 is a schematic view of an 8×8 embodiment the invention.

The rules of the game are described with reference to FIGS. 1-16 according to the following:

As seen in reference to FIG. 1, an 8×8 embodiment of the game comprises a circular patterned grid 10 defined by an equal number of rows 16 extending radially outward from a center of the circular grid 10, and number of concentric rings 18 defined about the center of the circular grid 10. In this embodiment, there are eight (8) concentric rings 18 and eight (8) rows 16.

The grid 10 has a plurality of fields 12, defined as the area, or space, between the intersection of the lines defining the rings 18 and the radial lines defining lateral boundaries of the rows 16. Each field 12 will be filled with a character 14 according to the rules of the game. The characters 14 may be any one of an alpha numeric character, a symbol, or even an image, provided that there is a unique set of characters 14 corresponding to the number of rows 16 defining the grid 10. The grid 10 is shown with a puzzle solution utilizing a set of eight unique characters 14, represented by the numbers one (1) through eight (8).

Rules

Figure 2:
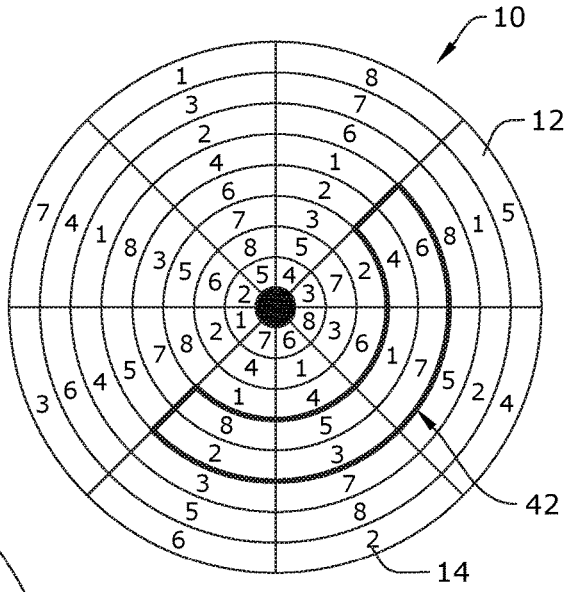
FIG. 2 is a schematic view indicating a definition of a Random Pattern 42 indicated by the bold lines.

As shown in reference to FIG. 2, a random pattern 42 may be indicated on a grid 10 with bold or distinguishing border line about the fields 12 contained within the random pattern 42. Alternatively, a random pattern 42 may be indicated by shading or coloring of the background within the fields 12 within the random pattern.

Figure 3:
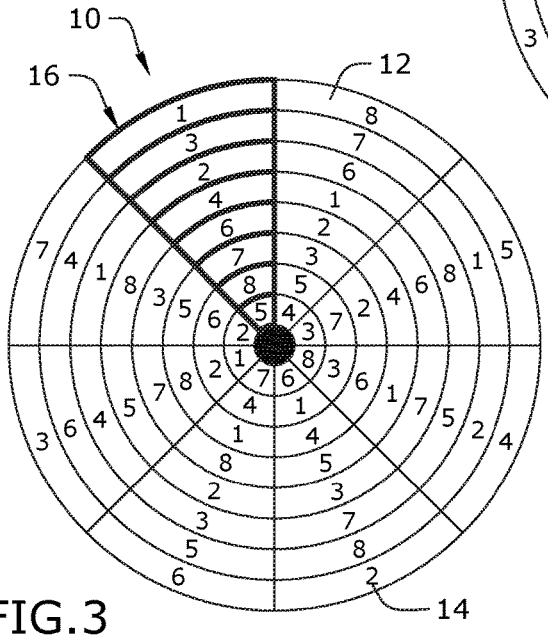
FIG. 3 is a schematic view indicating a definition of a row 16, shown by the bold lines.

As shown in reference to FIG. 3, a definition of a row 16 is indicated in bold. A number of circles divide each row 16. A row 16 extends from the center of the grid 10 to the outmost edge of the circular grid 10.

Figure 4:
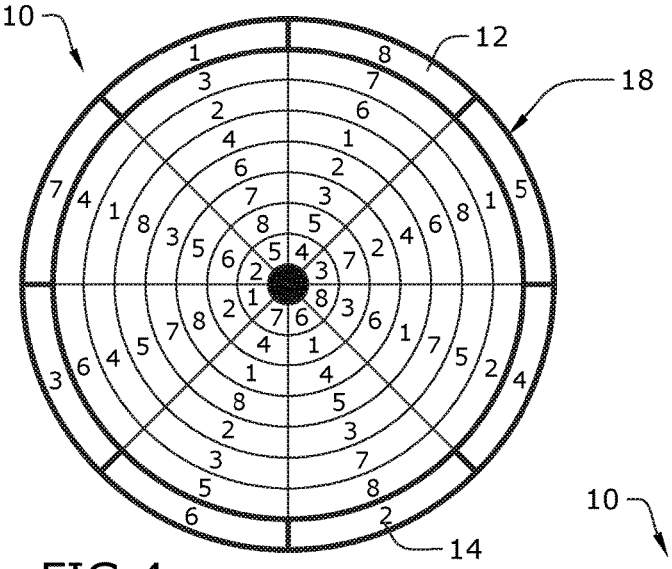
FIG. 4 is a schematic view of the invention illustrating a "ring within a circle" 18.

As shown in reference to FIG. 4, a definition of a "Ring within a circle" 18, is illustrated. A circle is divided in equal parts that are equivalent to the number of rows 16. In this example, eight (8) sections and its respective fields 12 are in the "ring within a circle" 18 because of there are eight (8) rows 16 that are present.

Figure 5:
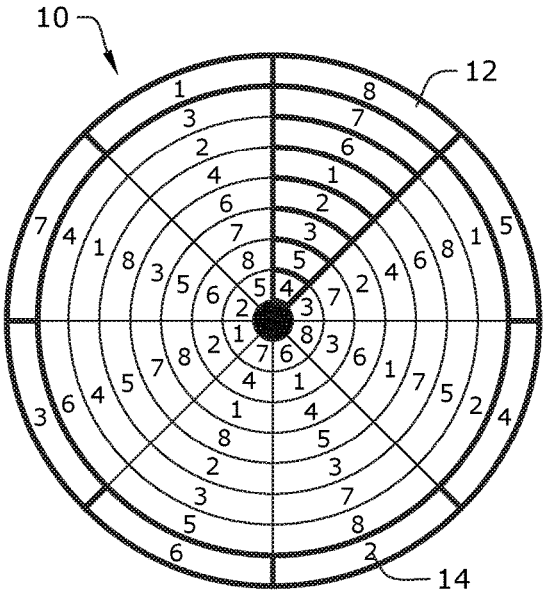
FIG. 5 is a schematic view of the invention, illustrating a row and a ring within a circle.

As shown in reference to FIG. 5, each character 14 is unique amongst each row 16 as well as each "ring within a circle" 18. In this example with eight (8) characters 14, the row 16 has the numbers 1, 2, 3, 4, 5, 6, 7, and 8. All eight (8) characters 14 are different values. The same eight (8) characters 14 are in the bold "ring within a circle" 18.

Figure 6:
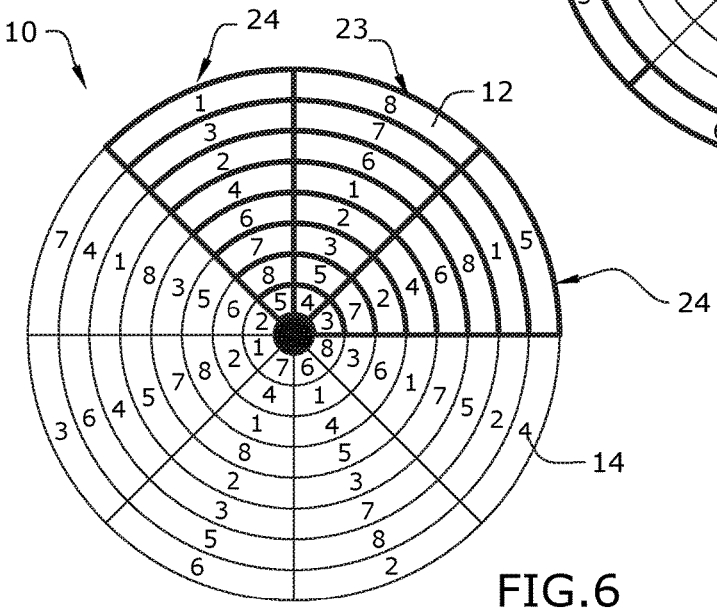
FIG. 6 is a schematic view of the invention, illustrating adjacent rows 23 & 24 and a rule for adjacent fields.

As shown in reference to the bold areas in FIG. 6, represent adjacent rows 24 to the center row 23. The center row's 23 outer most field 12 has a character 14 represented as the number eight (8). The field 12 which has the number eight (8) has adjacent fields 12 which consist of the numbers one (1), seven (7), and five (5). Each field's character 14 must never be adjacent to a field containing the same (like) character 14. As shown the number eight (8) is not the same (like) character 14 as the numbers one (1), seven (7), and five (5) that occupy the adjacent fields 12 in the example.

Figure 7:
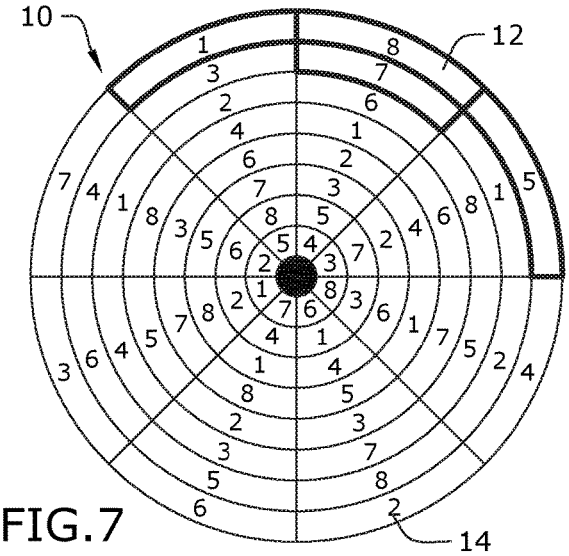
FIG. 7 is a schematic view of the invention illustrating a clarification of the rule illustrated and described with respect to FIG. 6.

As seen in reference to FIG. 7, further clarifying the rule of FIG. 6, the field 12 has the number eight (8), which has adjacent fields which consist of the numbers one (1), seven (7), and five (5) that occupy the adjacent fields 12 in the example.

Figure 8:
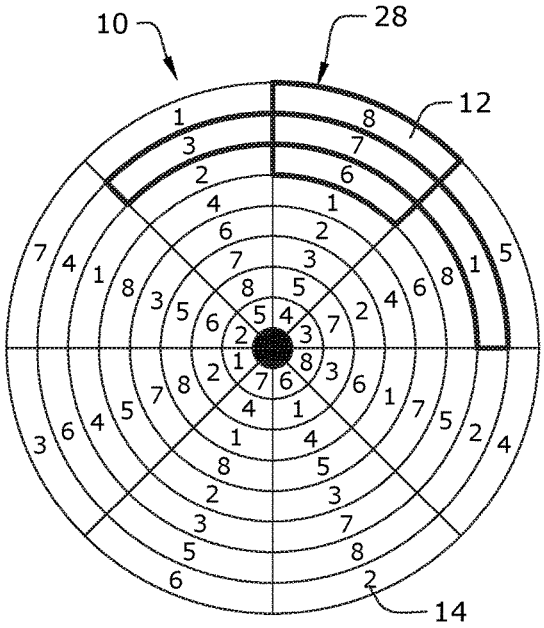
FIG. 8 is a schematic view of the invention, further illustrating a rule and adjacent fields 28.

In the bold field areas 28 as shown in reference to FIG. 8, the field 12 with the character seven (7) is not adjacent to another field with its same (like) character seven (7). In this example, the four adjacent fields to the character seven (7) are adjacent to fields containing the characters eight (8), three (3), six (6), and one (1).

Figure 9:
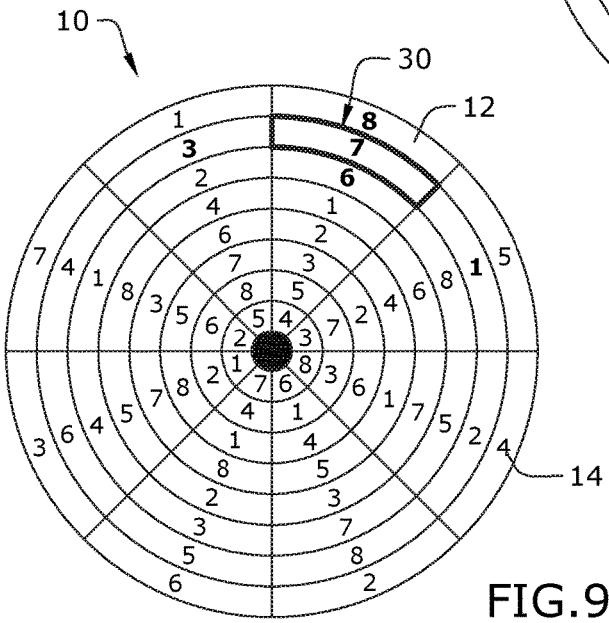
FIG. 9 is an alternative schematic view of the invention, illustrating a rule and adjacent fields 30.

As further illustrated in reference to FIG. 9, the puzzle's logic is that no character's adjacent fields are equivalent as itself. This example shows the bold border 30 to further illustrate the adjacent character fields 14 for the character number seven (7), of which the four adjacent fields (shown with bold characters 14) do not contain the same character 14 as itself (7). The top side character is eight (8), the bottom side character is six (6), the left side character is three (3), and the right side character is one (1). The entire puzzle is logically solved in a manner that all characters are in each row 16, and "rings within circles" 18 that have no equivalent character 14 on its sides (see drawing 1).

Figure 10:
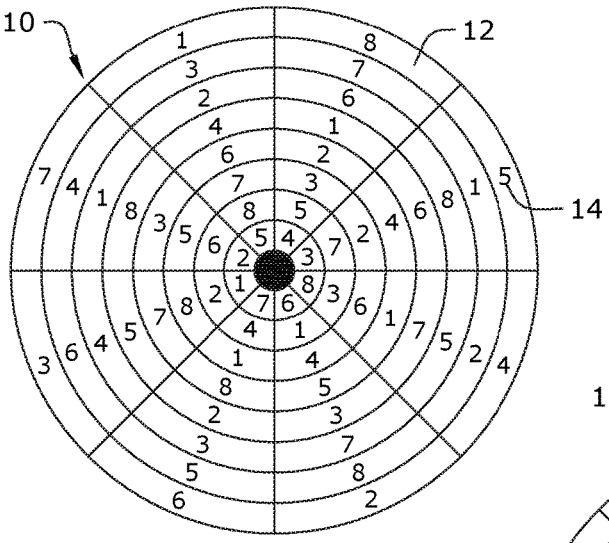
FIG. 10 is a schematic view of the invention, illustrating a game solution without a designated random pattern.
Figure 11:
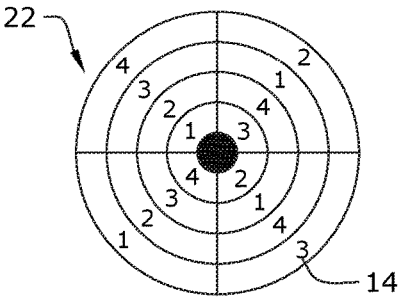
FIG. 11 is a schematic view of an alternate 4×4 embodiment of the invention 22.

As illustrated in reference to FIG. 10, the number of characters 14 in a puzzle 10 should always be equal to the number of rows 16 and "rings within circles" 18, of which can be any number. In this example, the 8 rows 16 have 8 "rings within circles" 18. FIG. 11 illustrates an example of a random pattern inserted as a variation to this four character game 22. The 4 rows 16 and 4 "rings within circles" 18 are shown as a 4×4 embodiment of the game 22.

Figure 12:
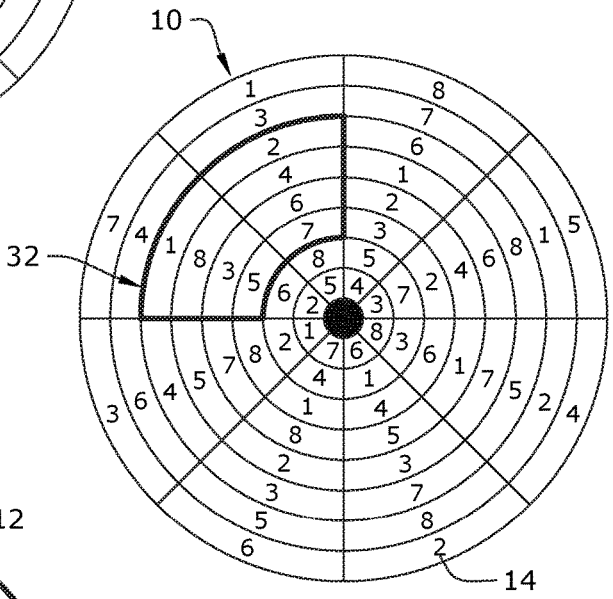
FIG. 12 is a schematic view of the invention, illustrating a random pattern 32.

The game 10 shown in reference to FIG. 12, illustrates an example of a different random pattern 32 inserted as a variation to this 8×8 character game 10, thus giving the logic puzzle more clues to arrive at a solution. Notice this bold random pattern 32 has eight (8) unique characters 14 contained within its fields 12.

Figure 13:
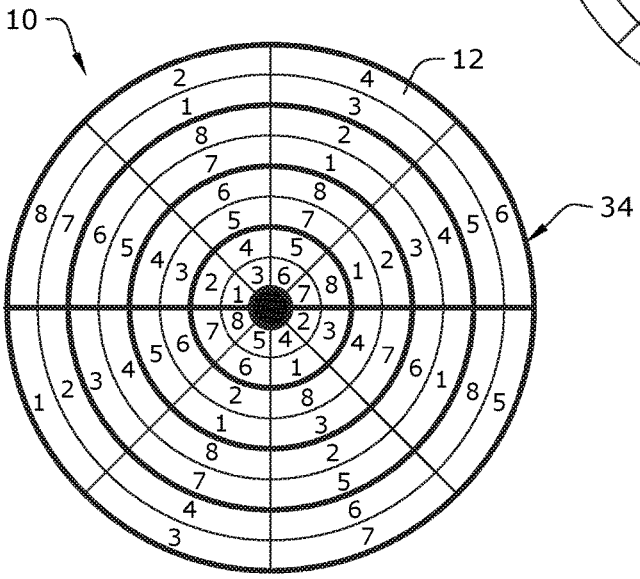
FIG. 13 is a schematic view of the invention, illustrating a puzzle with a plurality of random patterns 34.
Figure 14:
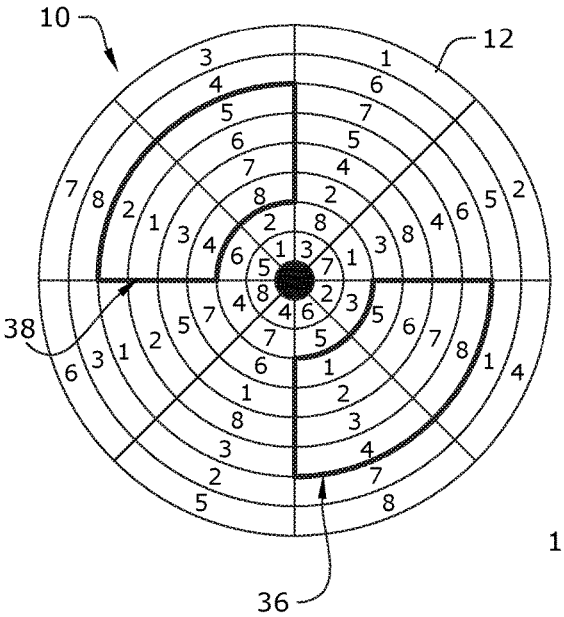
FIG. 14 is a schematic view of the invention illustrating an alternative embodiment illustrating a puzzle with a plurality of random patterns 36 & 38.
Figure 15:
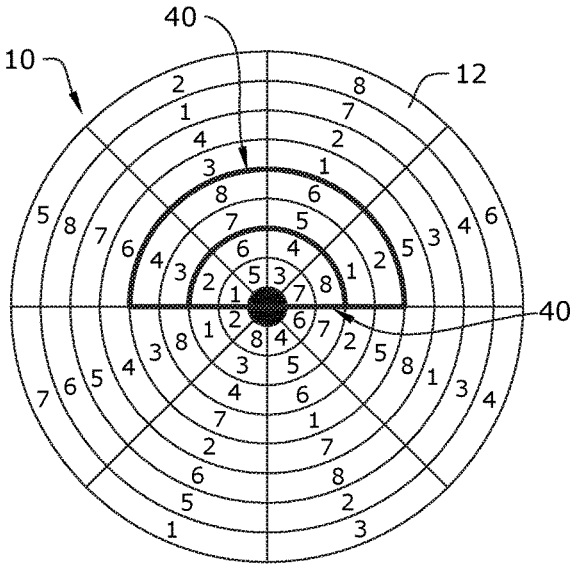
FIG. 15 is a schematic view of the invention illustrating an alternative embodiment illustrating a puzzle with a plurality of random patterns 40.
Figure 16:
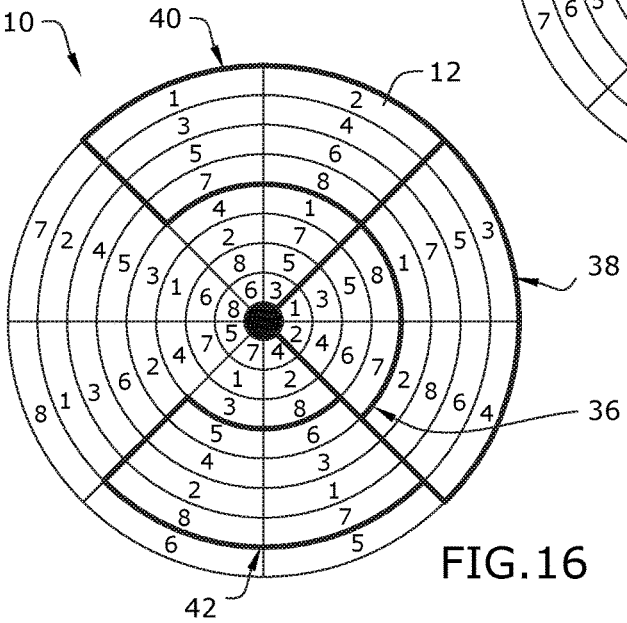
FIG. 16 is a schematic view of the invention illustrating an alternative embodiment illustrating a puzzle with a plurality of random patterns 36, 38, 40, and 42.

The game 10 illustrated in reference to FIG. 13, depicts a plurality of random patterns 34 may be inserted in the puzzle 10, with different bold random patterns 34 inserted in each puzzle 10. This illustrates that any circular puzzle 10 may have none and any number of bold random patterns 34 inserted in the puzzle.

Figure 17:
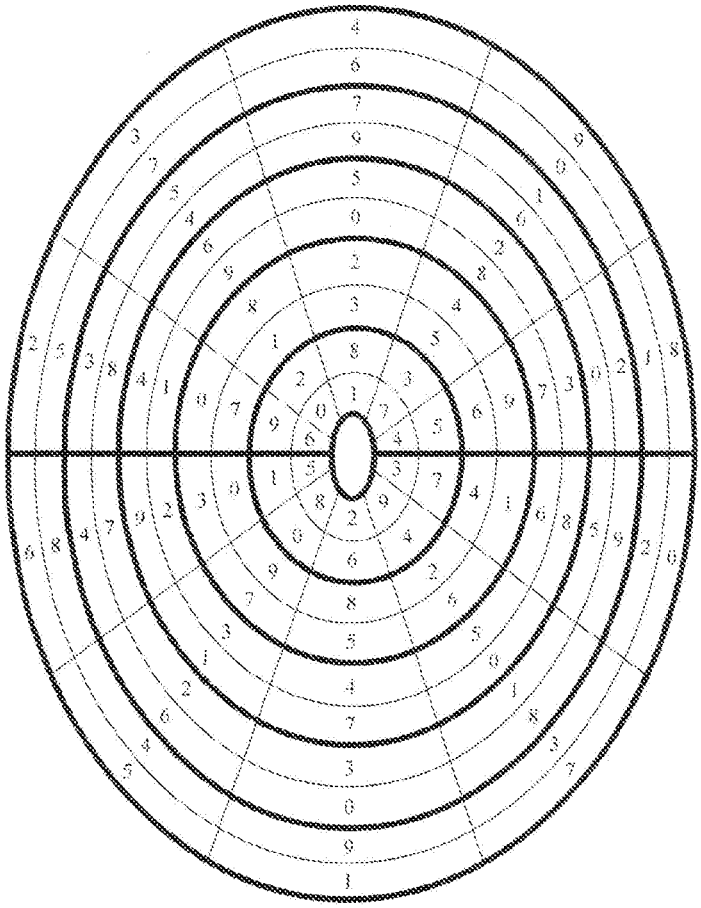
FIG. 17 is a view of an oval shaped puzzle illustrating an alternative embodiment of the invention.

This new logic puzzle game has a different perspective which has a circular or oval type format, such as seen in reference to FIG. 17. All references to this format will be called "CIRCULAR" throughout this specification. This game has similar rules to Latin squares and in some circumstances Sudoku, and this puzzle game has a refreshing new perspective that can have any number of predetermined characters 14 to provide any level of difficulty to arrive at a solution.

This is a solitary type puzzle game based on a set of rules similar to an ancient game called Latin squares. Bold patterns may be inserted into the puzzle game of which the unique bold random pattern would be solved in a manner like the game Sudoku. This logic puzzle game is of a circular or oval type design format, with the number of rows 16, defined as radially extending from the center of the circle, of which will be equivalent to the number of "rings within a circle".

As further illustrated with respect to FIGS. 2, 14, 15, and 16, random bold patterns may be inserted into this puzzle 10 anywhere and puzzles 10 may have any number of bold random patterns. In each bold random pattern, every field 12 within the random pattern 36, 38, 40, and 42 will have a character 14 not equivalent to any other character 14 field within that unique random pattern. Random Bold Patterns can be inserted in any fashion, and/or any number of random bold patterns can be inserted in this type circular puzzle. These variations give the circular type puzzle endless amounts of challenges that gives many new perspectives to this new logic type puzzle The rules of this circular logic game are always the same as described previously. The number of characters 14 and rows 16 and "rings within the circle" 18 can be defined with any number to give the logic problem solver many new, challenging and interesting variations of this circular type puzzle 10.

The game 10 of the present invention may be completed manually by inserting a character 14 in different fields 12 following the set of rules previously discussed. Typically, the clues would be in fields 12 that are already solved for the puzzle solver, of which a random number of clues would be given. The more clues given, the easier it would be for the puzzle solver.

The variables would be the number of characters 14 and fields 12, the number and type of bold patterns inserted in the puzzle 10, and the number of clues (fields already solved and given to the puzzle solver) of which the difficulties would be based upon. The puzzle solver is also given fields 12 that show no characters 14 inserted. The puzzle solver then has to solve the predetermined, finished solution of the puzzle based on the rules of this game with the clues given initially.

As will be appreciated; this logic type puzzle 10 could be solved either on print or using a computer generated puzzle, such as an app for a mobile computing device, such as a smartphone, tablet, and the like.

It should be understood, of course, that the foregoing relates to exemplary embodiments of the invention and that modifications may be made without departing from the spirit and scope of the invention as set forth in the following claims.

What is claimed is:

1. A game comprising:

a playing surface carrying indicia of a circular grid defined by a number of concentric circular lines disposed in a spaced apart relation and a number of radial lines extending in a spaced apart relation from a center of the circular grid and intersecting the concentric circular lines; wherein the number of concentric circular lines is equal to the number of radial lines;

a plurality of fields defined between an adjacent pair of radial lines and an adjacent pair of circular lines, wherein a row is defined by the plurality of fields between the adjacent pair of radial lines, and a ring of circles is defined by the plurality of fields between the adjacent pair of circular lines; and a set of unique characters, wherein a number of unique characters within the set is equal to the number of radial lines; wherein only one character may occupy a single field, any adjacent field cannot contain an identical character, the fields within each row contain one of each character within the set, and the fields within each ring of circles contain one of each character within the set.

2. The game of claim 1, further comprising:

indicia indicating a random pattern on the circular grid, the random pattern defining a number of contiguous fields corresponding to the number of radial lines.

3. The game of claim 2, wherein the fields within the random pattern contain one of each character within the set.

4. The game of claim 2, wherein the random pattern is defined by a discrete set of fields.

5. The game of claim 2, wherein the random pattern is defined by an overlapping set of fields.

6. The game of claim 1, wherein the set of characters comprises numbers.

7. The game of claim 1, wherein the set of characters comprises symbols.

8. The game of claim 1, wherein the set of characters comprises images.

9. The game of claim 1, wherein the playing surface is presented on a computer display.

10. A method of game play, comprising:

providing a playing surface carrying indicia of a circular grid defined by a number of concentric circular lines disposed in a spaced apart relation and a number of radial lines extending in a space apart relation from a center of the circular grid and intersecting the concentric circular lines; wherein the number of concentric circular lines is equal to the number of radial lines, a plurality of fields defined between an adjacent pair of radial lines and an adjacent pair of circular lines, wherein a row is defined by the plurality of fields between the adjacent pair of radial lines, and a ring of circles is defined by the plurality of fields between the adjacent pair of circular lines;

selecting a set of unique characters, wherein a number of unique characters within the set is equal to the number of radial lines; and populating the fields with the characters wherein only one character may be placed to occupy a single field, any adjacent field cannot contain an identical character, the fields within each row contain one of each character within the set, and the fields within each ring of circles contain one of each character within the set.

11. The method of claim 10, further comprising:

applying indicia indicating a random pattern on the circular grid, the random pattern defining a number of contiguous fields corresponding to the number of radial lines; and populating the fields with the characters wherein the fields within the random pattern contain one of each character within the set.

12. The method of claim 11, further comprising:

providing a clue, wherein one or more characters are pre-populated in the fields.

* * * * *